United States Patent [19]

Chang

[11] Patent Number: 4,932,294

[45] Date of Patent: Jun. 12, 1990

[54] DIY ELECTRIC HAND TOOL HAVING A CHAMBER FOR ACCOMMODATING TOOL HEADS NOT IN USE

[76] Inventor: Jung C. Chang, No. 127, Shangping Li, Chutung, Hsinchu, Taiwan

[21] Appl. No.: 381,534

[22] Filed: Jul. 18, 1989

[51] Int. Cl.[5] ..... B25G 1/00

[52] U.S. Cl. ..... 81/490; 81/177.4; 408/241 R; 206/234

[58] Field of Search ..... 81/177.4, 490; 206/234, 206/376–379; 408/239, 241 R

[56] References Cited

U.S. PATENT DOCUMENTS

| | | | |
|---|---|---|---|
| 1,596,951 | 8/1926 | Smith | 81/177.4 X |
| 4,302,990 | 12/1981 | Chrichton et al. | 81/177.4 X |
| 4,477,213 | 10/1984 | Nelson et al. | 408/241 R |
| 4,627,315 | 12/1986 | Lin | 81/177.4 |
| 4,653,356 | 3/1987 | Golden | 81/177.4 X |

*Primary Examiner*—James G. Smith
*Attorney, Agent, or Firm*—Brumbaugh, Graves, Donohue & Raymond

[57] ABSTRACT

A DIY electric hand tool is provided to include a hand grip portion. A battery received in the interior of the hand grip portion supplies electric power necessary for the operation of the hand tool. A lower end of the hand grip portion is enclosed by two half-shells pivotably mounted thereto. an inner space suitable to accommodate tool heads and having a lower end opening is formed between the walls of the hand grip portion and the walls of the half-shells. A tool head receiving plate assembly has means for attaching it to a bottom end of the battery with the battery being located centrally on an upper surface of the plate assembly when they are held together. Along each of two longer edges of the plate assembly is provided with a plurality of tool head receptacles, each of which is suitable to receive a tool head. The plate assembly is configured so that when the battery is inserted into the interior of the hand grip portion, the plate assembly attached to the bottom end of the battery will close the lower end opening of the inner tool head accommodating space, with the tool head receptacles protruding into the accommodating space. By pivoting any of the half-shells to an open position, the tool head receptacles are accessible to allow a tool head to be inserted or withdrawn. Means for securly holding the plate assembly to the lower end of the hand grip portion is also provided.

5 Claims, 6 Drawing Sheets

DIY ELECTRIC HAND TOOL HAVING A CHAMBER FOR ACCOMMODATING TOOL HEADS NOT IN USE

BACKGROUND OF THE INVENTION

The present invention relates generally to an improved electric hand tool and, particularly, to an improved DIY (Do It Yourself) electric hand tool which has a chamber for accommodating tool heads not in use.

A conventional DIY electric hand tool has a power source supplied by a rechargable Ni-Cd battery which supplies electric power to the electric motor in the hand tool. The motor drives a tool head, such as a drill bit or a screw driver. As shown in FIGS. 1 and 2 of the accompanying drawings, a conventional DIY hand tool 1 includes a driving portion 2 receiving the driving motor (not shown), and a hand grip portion 3 extending from and substantially normal to a rear end of the driving portion 2. The hand grip portion 3 has an empty inner space suitable for receiving a Ni-Cd battery 4. In addition to a mechanism (not shown in the drawings) arranged in a conventional manner in the interior of the hand grip portion 3 for clamping the battery 4, a snap plate 5 is provided at a tail end of a free end of the hand grip portion 3 for retaining the battery 4 in the inner space of the grip portion 3. A pair of tabs 6 are provided on either side of a lower end of the battery 4. A user may withdraw the battery 4 from the inner space of the grip portion 3 by gripping the tabs 6 with his/her fingers.

No chamber for accommodating tool heads is provided in the above-mentioned known DIY hand tool 1. A separate container is needed to hold tool heads not in use. A user of the DIY hand tool is therefore compelled to carry a tool head container when he/she must move in the working area.

Efforts have been made in the art to provide a tool head receiving space in the wall of the housing of the driving portion 2. The receiving space so provided usually includes two grooves arranged in the upper wall of the driving portion 2 for accommodating only two tool heads. While a DIY hand tool is normally accompanied with more than two tool heads of different types, a hand tool with only two grooves for receiving tool heads is unsatisfactory.

SUMMARY OF THE INVENTION

In view of the above, the primary object of the present invention is to provide an improved DIY electric hand tool of a configuration which has a chamber at a lower end of a hand grip portion of the DIY tool for accommodating tool heads not in use so as to eliminate the necessity of an additional container for holding tool heads.

A second object of the present invention is to provide an improved DIY hand tool having a chamber which includes more than two, even up to eight, positions for receiving tool heads.

A further object of the present invention is to provide an improved DIY hand tool having a chamber of a construction which is novel, easy to manufacture and assemble, and convenient to use.

To achieve the above-mentioned and other objects, a DIY electric hand tool in accordance with the present invention comprises: a hand tool body having a driving portion adapted for engaging a tool head and for receiving an electric motor disposed to drive the tool head, and a hand grip portion substantially vertically integrated with the driving portion and having a housing adapted for the accommodation of a battery supplying electric power to the driving motor, the hand grip portion having first pivoting means provided outside of the housing of a free end thereof, the battery having slidably engaging means on an outside surface of a lower end thereof; a pair of half-shells, each having second pivoting means adapted to pivotably mount the respective half-shell to the first pivoting means so that each of the half-shells is allowed to pivot on the first pivoting means between an open position and a close position, the half-shells forming an outer housing enclosing the housing of the hand grip portion at a lower end of the free end thereof when the half-shells are in the close position, the cross sectional area of the outer housing formed by the half-shells in the close position being larger than that of the housing of the free end of the hand grip portion so that a space suitable to accommodate tool heads is formed between the walls of the outer housing and the walls of the housing of the free end of the hand grip portion; and a tool head receiving plate assembly including a substantially rectangular, flat base plate having an outer peripheral profile and a surface area both substantially the same as an inner peripheral profile and an inner cross sectional area of a lower end opening of the outer housing formed by the half-shells in their close position, groove means provided on an upper surface of the base plate centrally along each of the two longer side of the base plate and adapted to slidingly engage with the slidably engaging means of the battery, and a plurality of tool head receptacles disposed at both sides of the groove means along each of the two longer sides of the base plate, each receptacle being adapted to receive a tool head; whereby, the tool head receiving plate assembly may be attached to the lower end of the battery by sliding engagement between the groove means and the slidably engaging means; when the battery is inserted into the interior of the housing of the hand grip portion, the base plate of the plate assembly closes the lower end opening of the outer housing formed by the half-shells in the close position, with the tool head receptacles protruding into the tool head accommodating space intervening between the walls of the half-shells and the walls of the housing of the free end of the hand grip portion; by pivoting one of the half-shells on the first pivoting means to the open position, the tool head receptacles on the same side as the opened half-shell are accessible to allow a tool head to be withdrawn or inserted.

Preferably, according to a preferred embodiment of the present invention, the groove means has a stop portion adapted to prevent the slidably engaging means of the battery from excessively sliding beyond the groove means; when the slidably engaging means meets the stop portion, the battery is substantially in the central area of the upper surface of the base plate.

Preferably, according to a second preferred embodiment of the present invention, each of the half-shells has first snapping-in means, and the free end of the hand grip portion has first retaining means adapted to releasably engage with the first snapping-in means so as to retain the half-shells in the close position.

More preferably, according to an another preferred embodiment of the present invention, the tool head receiving plate assembly has second snapping-in means, and the free end of the hand grip portion is further configured with second retaining means adapted to releasably engage with the second snapping-in means so as to retain the plate assembly to be securely attached to the lower end of the hand grip portion by the engagement btween the second snapping-in means and the second retaining means when the battery is inserted into the interior of the housing of the hand grip portion with the tool head receiving plate assembly, which has been attached to the lower end of the battery, closing the lower end opening of the outer housing formed by the two closed half-shells.

Furthermore, according to still another preferred embodiment of the present invention, the amount of the tool head receptacles on the tool head receiving plate assembly is eight.

BRIEF DESCRIPTION OF THE DRAWINGS

The foregoing and other objects and features of the present invention can be more fully understood by reference to the folowing description and accompanying drawings, which form an integral part of this application.

DETAILED DESCRIPTION OF THE PREFERRED EMBODIMENTS

Figure 1:
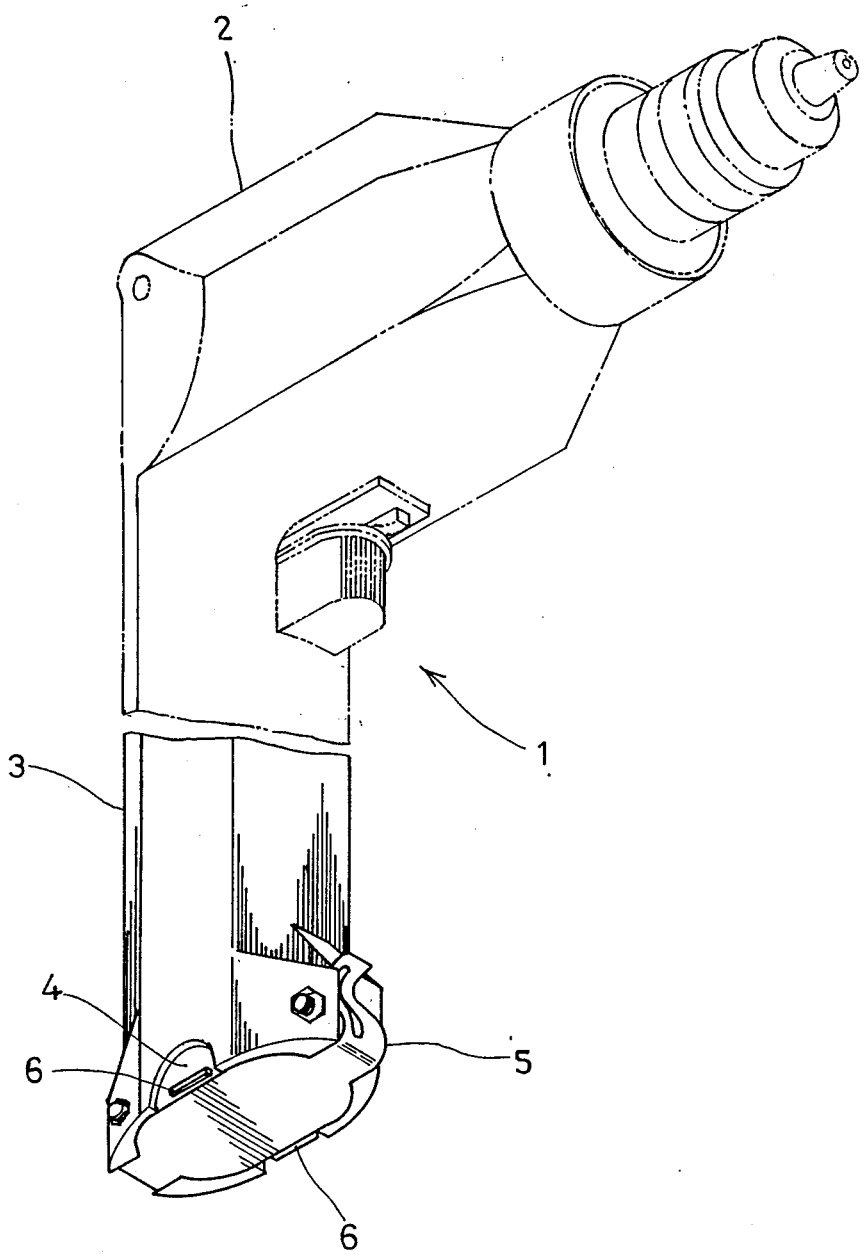
FIG. 1 shows a schematic perspective view of a conventional DIY hand tool, with the driving portion 2 and the upper section of the hand grip portion 3 being illustrated in broken lines, and the lower free end of the hand grip portion in solid lines for comparison with the present invention.
Figure 2:
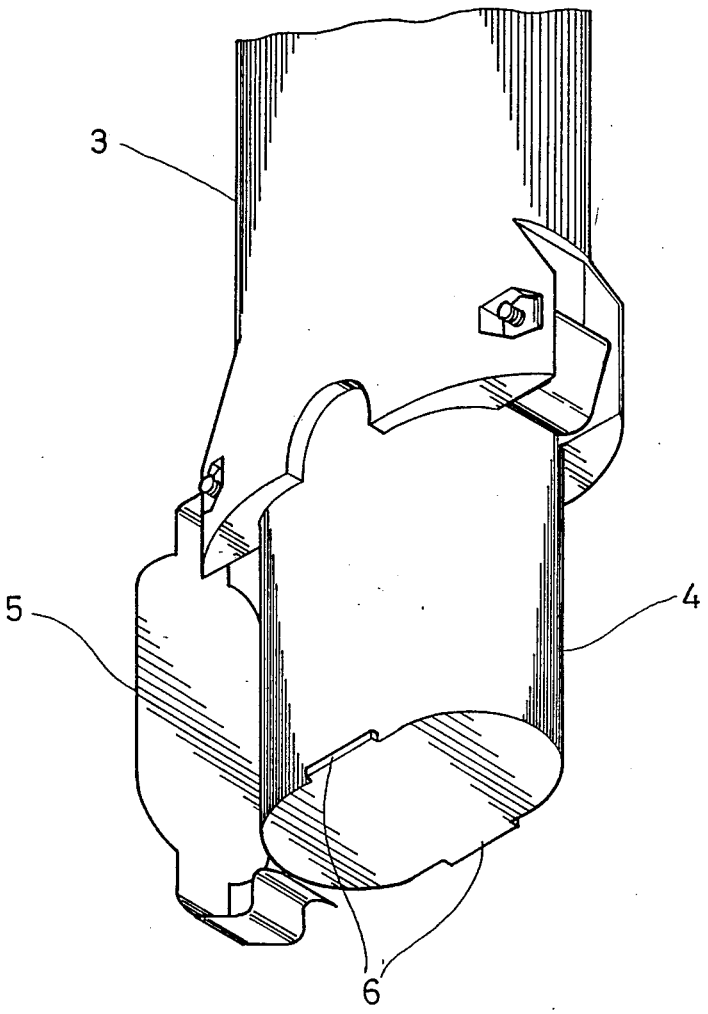
FIG. 2 shows a fragmentary perspective view of the lower free end of the hand grip portion of the conventional DIY hand tool shown in FIG. 1, with the battery partially withdrawn.
Figure 3:
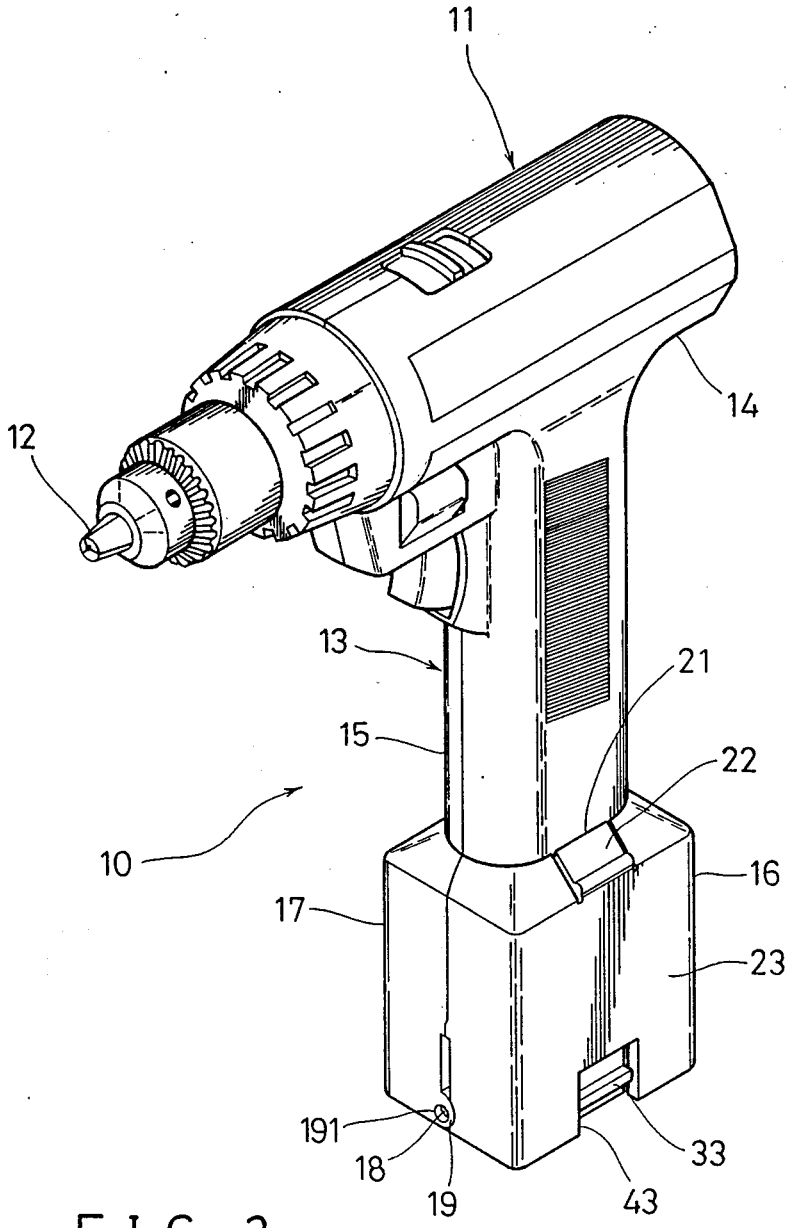
FIG. 3 shows a perspective view of a DIY hand tool constructed according to a preferred embodiment of the present invention, with the half-shells of the tool head receiving chamber in the close position.

Referring to FIGS. 3 to 6, a DIY electric hand tool constructed according to various aspects of the present invention is illustrated. As shown in FIG. 3, a new DIY hand tool 10 constructed according to a preferred embodiment of the present invention has a driving portion 11 in which an electric motor and a speed reducing mechanism drive a tool head (not shown in the figure) engaged by a front end 12 of the driving portion 11. A hand grip portion 13 substantially vertically extends downwardly from a portion near a rear end 14 of the driving portion 11. The interior of the hand grip portion 13 is empty so as to accommodate a conventional rechargable Ni-Cd battery adapted to supply electric power to the motor. The technique to mount the electric motor, speed reducing mechanism, and the battery in the hand tool is apparent to a person ordinarily skilled in the art and, therefore, will not be described in further detail.

An expanded chamber is formed by two half-shells 16, 17 surrounding a free end 15 of the hand grip portion 13 so as to provide a tool head receiving space therein. Each of the half-shells 16, 17 is open at its lower end and has a pair of opposite pivoting ears 19 located adjacent to the lower end. Each ear 19 has a through hole 191 adapted to pivotably receive one of a pair of short shafts 18 extending outwardly in opposite directions from two outer peripheral, diametric locations at the lower end of the free end 15. When assembled, the pivoting ear 19 of half-shell 16 and the pivoting ear 19 of half-shell 17 at the same side are mounted on a short shaft 18 on that side, with one of the pivoting ear 19 of half-shell 16 and the pivoting ear 19 of half-shell 17 being pivotably mounted to axes 18 which are parts of the free end 15 of the hand grip portion 13. As seen from FIG. 3, after they are assembled, half-shell 16 may be pivoted to an open position by pivoting on the short shafts 18 in a clockwise direction, and half-shell 17 may be pivoted to its open position by pivoting on the short shafts 18 in a counterclockwise direction.

Figure 4:
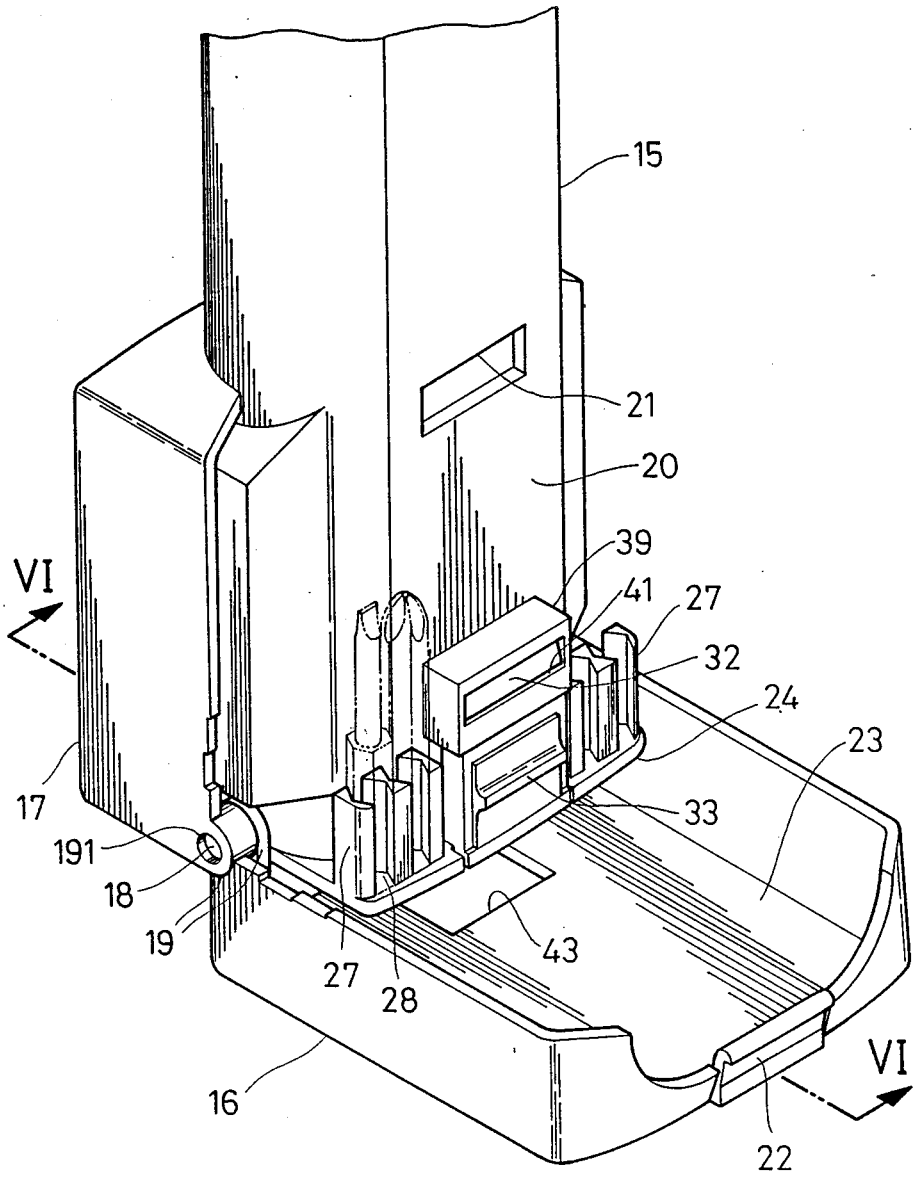
FIG. 4 shows a fragmentary perspective view of a lower free end of the hand grip portion of the DIY hand tool of the present invention shown in FIG. 3, with a half-shell opened to allow the tool head receptacles concealed therein to be accessed; wherein two tool heads in the types of different screwdrivers are illustrated in broken lines as representative examples of the tool heads which are suitable to be accommodated in the receiving chamber of the DIY hand tool of the present invention.
Figure 6:
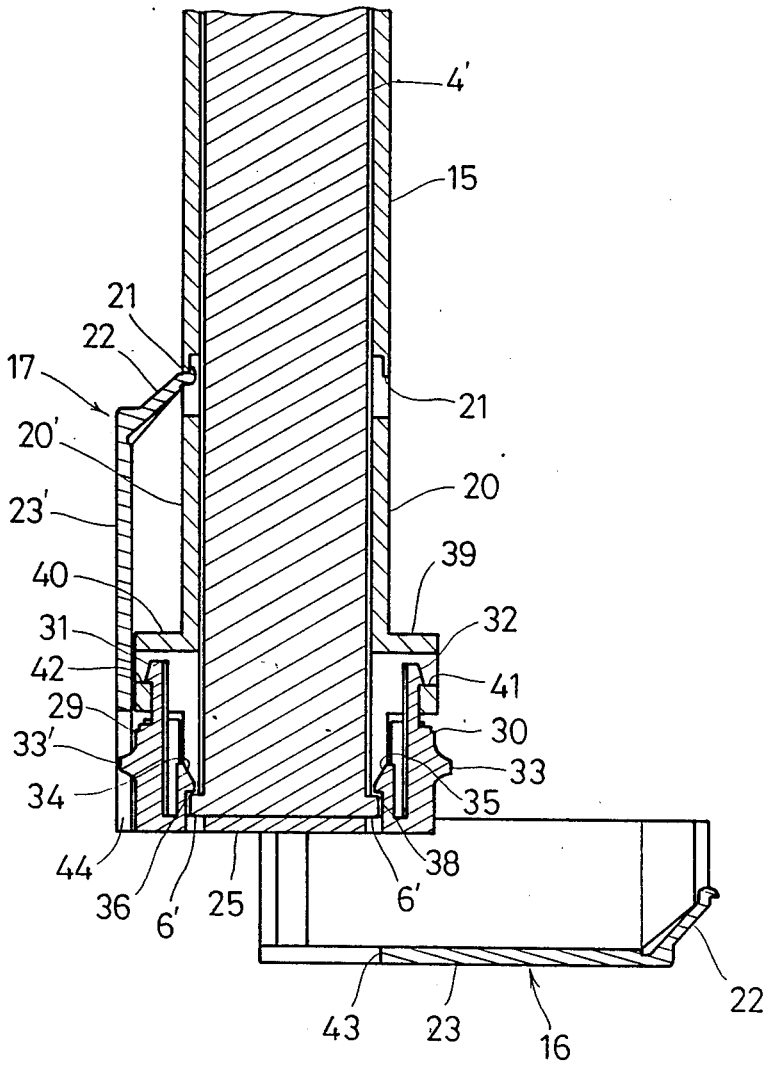
FIG. 6 is a cross sectional view taken from a vertical plane containing the line VI—VI of FIG. 4.

As shown in FIG. 4, each of the front and rear side walls 20 and 20' of the free end 15 is provided with an upper retaining slit 21, and each of the half-shells 16 and 17 is provided with a flexible snapping-in arm 22 at an upper end thereof. Only the snapping-in arm 22 of half-shell 16 and its mating slit 21 are shown in FIG. 4. The snapping-in arm of half-shell 17 and its mating slit are in a similar type to that of the snapping-in arm 22 of half-shell 16 and its mating slit 21. When half-shells 16, 17 are in their close positions, snapping-in arms 22 snap in respective retaining slits 21 so as to retain half-shells 16, 17 in their close positions (such as that of half-shell 17 as shown in FIG. 6). In order to open half-shell 16 or 17, a force is applied by a finger of a user to urge the arm 22 to be released from engagement with the upper retaining slit 21.

As seen from FIG. 6, the distance between the side walls 23 and 23' of the half-shells 16 and 17 is larger than that of the front and rear side walls 20 and 20' of the free end 15, creating an inner space suitable to accommodate tool heads to be placed between the side walls 23, 23' and side walls 20, 20'. The height dimensions of the half-shells 16, 17 are arranged to allow the inner space to be big enough to accommodate the length of each of tool heads which is usually used.

Figure 5:
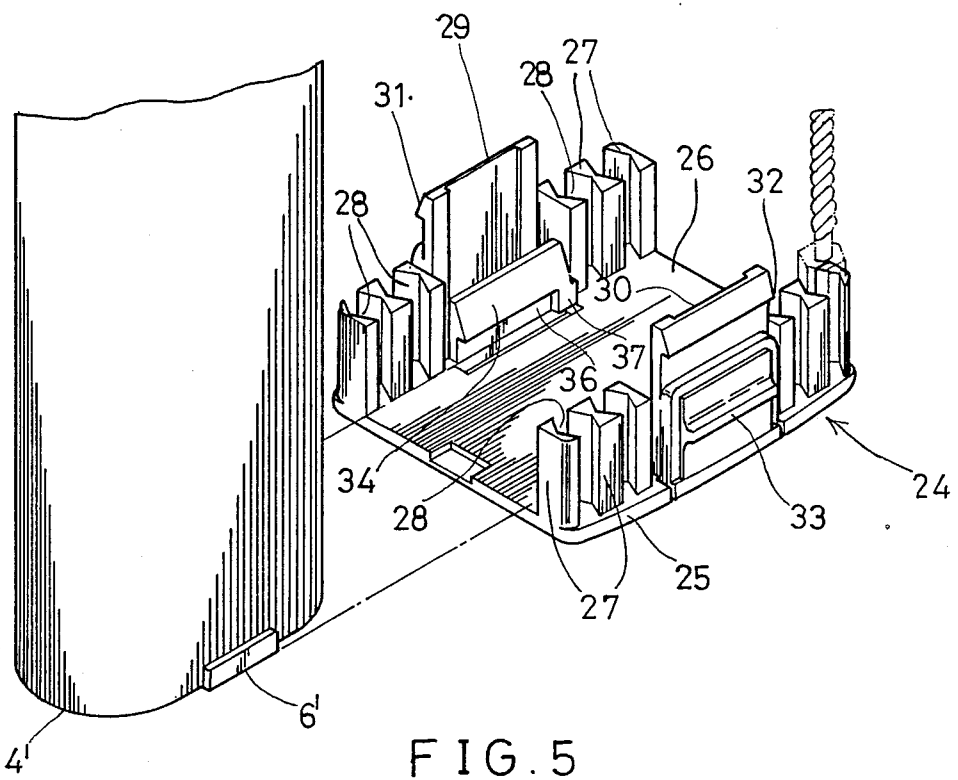
FIG. 5 shows a perspective view of a tool head receiving plate assembly used in the inventive hand tool, with a lower end of a Ni-Cd battery, to which the plate assembly is suitable to be attached, shown in a fragmentary perspective view; wherein a drill bit type tool head shown in phantom lines is received in a tool head receptacle.

It will be understood from FIG. 4 that a tool head receiving plate assembly 24 is provided in the present invention. As shown in FIG. 5, the assembly 24 includes a substantially rectangular, flat base plate 25, the dimension and contour of which are arranged so as to be suitable to close the lower end opening left by the closed half-shells 16, 17. A plurality of tool head receiving positions 28 are formed by spacing blocks 27 disposed on an upper surface 26 along each of two longer edges of the base plate 25. As shown in FIG. 5, there are eight receiving positions 28. Obviously, the amount of receiving positions 28 may be other than eight, depending upon the number of tool heads to be accommodated in the receiving chamber. Each of the receiving positions 28 has a cross sectional contour which is selected to match that of the base portion of a tool head to be inserted into the receiving position 28, for example a hexagonal contour.

In the embodiment illustrated in FIG. 5, the eight receiving positions 28 are divided into four sets, each set including two aligned receiving positions 28. Two sets of receiving positions 28 are located along one longer edge of the base plate 25, with the other two sets of receiving positions 28 along the other one longer edge of the base plate 25.

The assembly 24 of the present invention further has a mechanism to attach the assembly 24 to the lower end of the free end 15 of the hand grip portion 13. The mechanism includes two snapping-in arms 29, 30 extending upwardly from the upper surface 26 of the base plate 25 at two central positions along the two longer side edges of the base plate 25, and two grooved blocks 34, 35 aligned with the snapping-in arms 29, 30 and respectively located inside and adjacent to the snapping-in arms 29, 30. The snapping-in arm 29 (30) and the adjacent grooved block 34 (35) on the same side of base plate 25 intervene the two sets of receiving positions 28 on that side. The space between the two grooved blocks 34 and 35 is selected to be substantially equal to the thickness of the battery 4' so as to allow a bottom end of the battery 4' to be interposed between grooved blocks 34 and 35. To hold the bottom end of battery 4' between grooved blocks 34 and 35 and, in other words, to attach the assembly 24 to the bottom end of battery 4', the opposed inner surfaces of the grooved blocks 34, 35 are respectively provided with lateral sliding grooves 36 and 38. The dimensions of each of grooves 36, 38 are selected to permit the tabs 6' of battery 4' to insert slidingly. Each of grooves 36, 38 is open at one end thereof to allow one of the tabs 6' to be inserted along the longitudinal direction of the groove. At the other end of each of grooves 36, 38, a stop portion 37 is formed to prevent the tab 6' from excessively sliding beyond the grooved block 34 or 35. When the tab 6' inserted into a groove 36 or 38 abut against the stop portion 37, the battery 4' is located substantilly centrally on the upper surface 26 of the base plate 25. When the battery 4' is inserted entirely into the interior of the hand grip portion 13, the base plate 25 may properly close the lower end opening of the closed half-shells 16 and 17, with each of the tool head receptacles 28 protruding into the inner space between the side walls 23, 23' and 20, 20'.

In order to securely hold the tool head receiving plate assembly 24 at the lower end of the free end 15 of hand grip portion 13, retaining boxes 39, 40 are disposed respectively on side walls 20, 20' adjacent to the lower end of free end 15. A lower retaining slit 41, 42 is provided in an outer facing surface of each of retaining boxes 39, 40. The upper end of each of snapping-in arms 29, 30 has a lateral flange 31, 32 on the outside surface thereof. By the snapping-in engagement of the flanges 31, 32 of the arms 29, 30 with the lower retaining slits 41, 42, as shown in FIG. 6, the assembly 24 can be securely held at the lower end of the free end 15. To detach the assembly 24 from the free end 15, lateral ridges 33, 33' are provided at intermediate sections on the outside surfaces of snapping-in arms 29, 30, respectively. When the user presses on the ridges 33, 33' with his/her fingers, flanges 31, 32 may be released from the snapping-in engagement with the lower retaining slits 42, 41 so as to allow the assembly 24 along with the battery 4' to be withdrawn from the free end 15 of the hand grip portion 13. Furthermore, for the purpose of allowing the lateral ridges 33, 33' to become accessible to the fingers of the user, each of the side walls 23, 23' of the half-shells 16, 17 has a notch 43, 44 centrally along a respective lower edge thereof, causing ridges 33, 33' to be visible and accessible from the outside after half-shells 16, 17 have been closed.

Accordingly, a chamber suitable to receive tool heads not in use is provided at the free end 15 of the hand grip portion 13 of a DIY hand tool 10, eliminating the necessity to prepare an additional container or tool box for accommodating tool heads. By sliding tabs 6' of battery 4' into grooves 36, 38 of grooved blocks 34, 35, inserting battery 4' into the interior of free end 15, and engaging flanges 31, 32 of snapping-in arms 29, 30 into lower retaining slits 42, 41, the tool head receptacles 28 are concealed inside the half-shells 16, 17. By urging against the snapping-in arm 22 of half-shell 16 or 17 with a finger, the arm 22 may be disengaged from the mating upper retaining slit 21 to allow the half-shell 16 or 17 to be opened so that a tool head can be inserted into or withdrawn from a receptacle 28.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electric hand tool, comprising:

a hand tool body, having a driving portion adapted for engaging a tool head and for receiving an electric motor disposed to drive said tool head, and a hand grip portion substantially vertically integrated with said driving portion and having a housing adapted for the accommodation of a battery supplying electric power to said driving motor, said hand grip portion further having a free end and first pivoting means provided outside of said housing at said free end, said battery having slidably engaging means on an outside surface of a lower end thereof;

a pair of half-shells, each having second pivoting means adapted to pivotably mount the respective one of said half-shells to said first pivoting means so that each of said half-shells is allowed to pivot on said first pivoting means between an open position and a close position, said half-shells forming an outer housing enclosing said housing of said hand grip portion at a lower end of said free end thereof when said half-shells are in said close position, said outer housing having a lower end opening, the cross sectional area of said outer housing formed by said half-shells in said close position being larger than that of said housing of said free end of said hand grip portion so that a space suitable to accommodate tool heads is created between walls of said outer housing and walls of said housing of said free end of said hand grip portion; and a tool head receiving plate assembly, including a substantially rectangular, flat base plate having an outer peripheral profile and a surface area both substantially the same as an inner peripheral profile and an inner cross sectional area of said lower end opening of said outer housing, groove means provided on an upper surface of said base plate centrally along each of the two longer side of said base plate and adapted to slidingly engage with said slidably engaging means of said battery, and a plurality of tool head receptacles disposed at both sides of said groove means along each of said two longer sides of said base plate, each of said receptacles being adapted to receive a tool head;

whereby, said tool head receiving plate assembly may be attached to said lower end of said battery by a sliding engagement between said groove means and said slidably engaging means; when said battery is inserted into the interior of said housing of said hand grip portion, said base plate of said plate assembly closes said lower end opening of said outer housing formed by said half-shells in said close position, with said tool head receptacles protruding into said tool head accommodating space intervening between said walls of said half-shells and said walls of said housing of said free end of said hand grip portion; and by pivoting one of said half-shells on said first pivoting means to said open position, said tool head receptacles on the same side as said opened half-shell allow a tool head to be withdrawn or inserted.

2. An electric hand tool as claimed in claim 1, wherein said groove means has a stop portion adapted to prevent said slidably engaging means of said battery from excessively sliding beyond said groove means; when said slidably engaging means abuts against said stop portion, said battery is substantially in the central area of said upper surface of said base plate.

3. An electric hand tool as claimed in claim 1, wherein each of said half-shells has first snapping-in means, and said free end of said hand grip portion has first retaining means adapted to releasably engage with said first snapping-in means so as to retain said half-shells in said close position.

4. An electric hand tool as claimed in claim 1, wherein said tool head receiving plate assembly has second snapping-in means, and said free end of said hand grip portion is configured with second retaining means adapted to releasably engage with said second snapping-in means so as to retain said plate assembly to be securely attached to said lower end of said hand grip portion by the engagement between said second snapping-in means and said second retaining means when said battery is inserted into the interior of said housing of said hand grip portion with said tool head receiving plate assembly, which has been attached to said lower end of said battery, closing said lower end opening of said outer housing formed by said two closed half-shells.

5. An electric hand tool as claimed in claim 1, wherein the amount of said tool head receptacles on said tool head receiving plate assembly is eight.

* * * * *